US006622528B2

(12) United States Patent
Masse et al.

(10) Patent No.: US 6,622,528 B2
(45) Date of Patent: Sep. 23, 2003

(54) DOUBLE KNIT FABRIC WITH HOLES THERETHROUGH AND A TWO COLOR LAMINATED EFFECT FABRIC

(75) Inventors: François Masse, St-Hyacinthe (CA); Sylvain Vigeant, St. Liboire (CA)

(73) Assignee: Sport Maska Inc. (CA)

( * ) Notice: Subject to any disclaimer, the term of this patent is extended or adjusted under 35 U.S.C. 154(b) by 0 days.

(21) Appl. No.: 10/300,731

(22) Filed: Nov. 20, 2002

(65) Prior Publication Data

US 2003/0126894 A1 Jul. 10, 2003

(30) Foreign Application Priority Data

Nov. 20, 2001 (CA) ..... 2363425

(51) Int. Cl.[7] ..... D04B 9/06
(52) U.S. Cl. ..... 66/22; 66/196
(58) Field of Search ..... 66/22, 25, 196, 66/197, 198; 442/312, 318

(56) References Cited

U.S. PATENT DOCUMENTS

| | | | | |
|---|---|---|---|---|
| 872,163 A | | 11/1907 | Williams | |
| 3,392,552 A | | 7/1968 | Muller et al. | 66/169 |
| 3,576,115 A | | 4/1971 | Schmidt | 66/19 |
| 3,609,999 A | | 10/1971 | Blore | 66/196 |
| 3,626,714 A | | 12/1971 | Blore | 66/196 |
| 3,808,843 A | | 5/1974 | Blore et al. | 66/196 |
| 3,986,374 A | | 10/1976 | Fane | 66/190 |
| 4,019,350 A | | 4/1977 | Schmidt | 66/196 |
| 4,353,229 A | | 10/1982 | Hutchinson et al. | 66/197 |
| 4,356,710 A | | 11/1982 | Mizuno et al. | 66/192 |
| 4,587,811 A | | 5/1986 | Hiromoto et al. | 66/196 |
| 4,838,045 A | | 6/1989 | Cournoyer et al. | 66/196 |
| 4,891,958 A | * | 1/1990 | Cournoyer et al. | 66/196 |
| 4,941,331 A | * | 7/1990 | Cournoyer et al. | 66/25 |
| 5,031,425 A | | 7/1991 | Cournoyer et al. | 66/196 |
| 5,359,865 A | | 11/1994 | So | 66/19 |
| 5,373,713 A | | 12/1994 | Miller | 66/196 |
| 5,636,533 A | | 6/1997 | Hunneke et al. | 66/196 |
| 5,735,145 A | | 4/1998 | Pernick | 66/196 |
| 6,151,928 A | | 11/2000 | Anyon et al. | 66/196 |

* cited by examiner

*Primary Examiner*—Danny Worrell
(74) *Attorney, Agent, or Firm*—Factor & Partners

(57) ABSTRACT

This double knit fabric which may be used for sports garments or uniforms, namely sweaters and stockings, may include a repeating pattern of predetermined courses containing wales of consecutive selected groups of tuck and welt stitches to form holes in and throughout the knitted fabric. The pattern may be repeated to provide a fabric with a considerable number of holes aligned in a predetermined geometrical arrangement and a two different colored laminated effect.

18 Claims, 3 Drawing Sheets

KNIT x WELT o TUCK •

| | | N1 | N2 | N3 | N4 | N5 | N6 | N7 | N8 | N9 | N10 | N11 | N12 |
|---|---|---|---|---|---|---|---|---|---|---|---|---|---|
| C1- | DIAL | x | x | x | x | x | x | x | x | x | x | x | x |
| | CYL. | • | o | o | o | • | o | o | o | • | o | o | o |
| C2- | DIAL | o | o | o | o | o | o | o | o | o | o | o | o |
| | CYL. | x | x | o | x | x | x | o | x | x | x | o | x |
| C3- | DIAL | o | o | o | o | o | o | o | o | o | o | o | o |
| | CYL. | o | o | x | o | o | o | x | o | o | o | x | o |
| C4- | DIAL | x | x | x | x | x | x | x | x | x | x | x | x |
| | CYL. | • | o | o | o | • | o | o | o | • | o | o | o |
| C5- | DIAL | o | o | o | o | o | o | o | o | o | o | o | o |
| | CYL. | x | x | o | x | x | x | o | x | x | x | o | x |
| C6- | DIAL | o | o | o | o | o | o | o | o | o | o | o | o |
| | CYL. | o | o | x | o | o | o | x | o | o | o | x | o |
| C7- | DIAL | x | x | x | x | x | x | x | x | x | x | x | x |
| | CYL. | • | o | o | o | • | o | o | o | • | o | o | o |
| C8- | DIAL | o | o | o | o | o | o | o | o | o | o | o | o |
| | CYL. | x | x | o | x | x | x | o | x | x | x | o | x |
| C9- | DIAL | o | o | o | o | o | o | o | o | o | o | o | o |
| | CYL. | o | o | x | o | o | o | x | o | o | o | x | o |

| | | N1 | N2 | N3 | N4 | N5 | N6 | N7 | N8 | N9 | N10 | N11 | N12 |
|---|---|---|---|---|---|---|---|---|---|---|---|---|---|
| C10- | DIAL | x | x | x | x | x | x | x | x | x | x | x | x |
| | CYL. | o | o | • | o | o | o | • | o | o | o | • | o |
| C11- | DIAL | o | o | o | o | o | o | o | o | o | o | o | o |
| | CYL. | o | x | x | x | o | x | x | x | o | x | x | x |
| C12- | DIAL | o | o | o | o | o | o | o | o | o | o | o | o |
| | CYL. | x | o | o | o | x | o | o | o | x | o | o | o |
| C13- | DIAL | x | x | x | x | x | x | x | x | x | x | x | x |
| | CYL. | o | o | • | o | o | o | • | o | o | o | • | o |
| C14- | DIAL | o | o | o | o | o | o | o | o | o | o | o | o |
| | CYL. | o | x | x | x | o | x | x | x | o | x | x | x |
| C15- | DIAL | o | o | o | o | o | o | o | o | o | o | o | o |
| | CYL. | x | o | o | o | x | o | o | o | x | o | o | o |
| C16- | DIAL | x | x | x | x | x | x | x | x | x | x | x | x |
| | CYL. | o | o | • | o | o | o | • | o | o | o | • | o |
| C17- | DIAL | o | o | o | o | o | o | o | o | o | o | o | o |
| | CYL. | o | x | x | x | o | x | x | x | o | x | x | x |
| C18- | DIAL | o | o | o | o | o | o | o | o | o | o | o | o |
| | CYL. | x | o | o | o | x | o | o | o | x | o | o | o |

Figure 2

DOUBLE KNIT FABRIC WITH HOLES THERETHROUGH AND A TWO COLOR LAMINATED EFFECT FABRIC

RELATED APPLICATION

The present application claims the benefits of Canadian Preliminary Patent Application No. 2,363,425 filed Nov. 20, 2001, which is hereby incorporated by reference.

FIELD OF THE INVENTION

This invention relates to a double knit fabric which may be used for a variety of clothing and other applications employing cloth or fabric. In particular, the present invention may be used to make sporting clothing, in particular uniforms, such as sweaters and stockings, for players engaged in sporting activities.

BACKGROUND OF THE INVENTION

This invention is concerned with a type of double knit fabric of heavy construction embodying a considerable number of holes therethrough to allow control of the body heat with respect to perspiration of the player wearing same, when one is engaged in an active sport giving rise to many contacts with players or with equipment such as in, for example, hockey, football, soccer, softball, baseball, basketball, volleyball, rugby, broomball and ringuette.

All of these sports are team sports where there is a custom that the players of each team wear a distinctive uniform, which most of the time is made of a specific color arrangement and which may be, for example, a two color scheme. The invention relates to the construction of a knitted fabric for such sports.

It is an object of the present invention to provide a fabric made of a double knit structure with an arrangement of holes therethrough to provide comfort to the wearer engaged in an active sport or event.

A further object is to provide a fabric having a two color laminated effect, said laminated effect may be readily suitable for a great number of color arrangements of uniforms of variable dimensions, taking into account, the different sizes for players or wearers of different height or weight.

SUMMARY OF THE INVENTION

This double knit fabric which may be used for sports garments or uniforms, namely sweaters and stockings, may include a repeating pattern of predetermined courses containing wales of consecutive selected groups of tuck and welt stitches to form holes in and throughout the knitted fabric. The pattern may be repeated to provide a fabric with a considerable number of holes aligned in a predetermined geometrical arrangement and a two different colored effect.

The double knit fabric may be knitted, for example, on a mini-jacquard knitting machine which can make knit patterns on two adjacent sets of cylinder wales and intermediary dial wales for a certain number of feeds. A wale is defined as a column of loops in successive courses, which is the product of one needle, and a course is defined as a row of loops in successive wales, which is the product of one knitting revolution per yarn. The cylinder is the part of the double knit machine where the needles work in a vertical axis while the dial is the part of the double knit machine where the needles work in a vertical axis. The feed is a mechanism for repeatedly moving the yarn being stitched from one needle position to the next on a course.

In accordance with a particular aspect of the invention, there is provided for a fabric of double knit construction comprising:

- a repeating pattern of at least three courses, a first cylinder wale and a second cylinder wale,
  - said first cylinder wale comprising
    - a tuck stitch in one of said three courses so as to form a hole,
    - a knit stitch in one of the two other remaining courses of said three courses, and
    - a welt stitch in the last remaining course of the said three courses,
  - said pattern being repeated to form the fabric with a plurality of said holes,
    - a minimum spacing between a pair of adjacent said holes formed by the tuck stitch including one cylinder wale in a horizontal direction within the same course as said tuck stitch, two courses in a vertical direction within said first cylinder wale and one cylinder wale and two courses diagonally, and
- said second cylinder wale comprising two courses with welt stitches and a course with a knit stitch in the same at least three courses as said courses having the tuck stitch.

In accordance with a further aspect of the invention, there is provided for a fabric of double knit construction comprising:

- a repeating pattern of at least three courses, a first cylinder wale and a second cylinder wale,
  - said first cylinder wale comprising a course pattern of a tuck stitch, a knit stitch and a welt stitch, and
- said second cylinder wale comprising a course pattern of a welt stitch, a knit stitch and a welt stitch.

In accordance with yet a further aspect of the invention, there is provided for a fabric of double knit construction as described here above, wherein the fabric is knitted with yarns of a first color on said courses comprising at least one said tuck stitch and yarns of a second color for all other said courses so as to provide a two color effect.

BRIEF DESCRIPTION OF THE DRAWINGS

FIG. 2 is a different type of schematic view of the double knit structure.

DETAILED DESCRIPTION OF THE DRAWINGS

Figure 1:
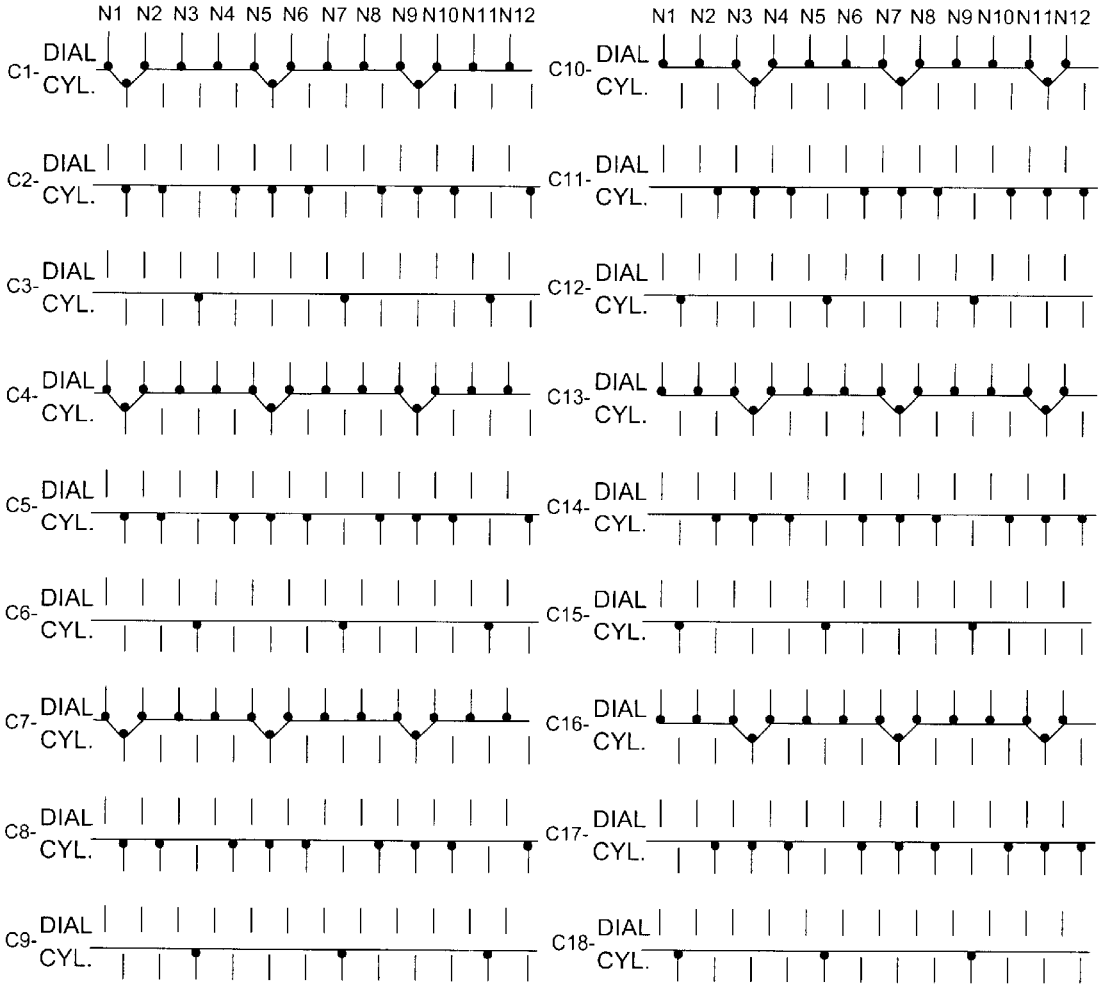
FIG. 1 is a schematic view, useful for explaining the double knit structure.

FIGS. 1 and 2 illustrate different representations of a particular embodiment of the present invention. Namely, FIGS. 1 and 2 represent a pattern of eighteen courses and two adjacent sets of nine cylinder wales and intermediary dial wales. Each course illustrated in FIGS. 1 and 2, identified by numbers C1 to C18 inclusive, has twelve needles on the cylinder and on the dial, identified by numbers N1 to N12 inclusive. One skilled in the art may readily observe that cylinder wales N1 to N4 inclusive are duplicates or repeat pattern for cylinder wales N5 to N8 as well as N9 to N12 inclusive, for the full eighteen courses of this particular embodiment.

From a further examination of FIGS. 1 and 2, one may visualize that the hole construction of the particular embodiment of the invention is repeated. In order to give the diagonal linear effect or alignment of the holes in the double knit fabric of the invention, the hole configurations of the two sets of courses C1 to C9 and C10 to C18 inclusive are offset, for example, to the right by two cylinder wales. For example, in reference to FIG. 1, and comparing courses C1, C4 and C7 with courses C10, C13 and C16 wherein the three tuck stitches on the cylinder of courses C1, C4 and C7 are positioned at cylinder wales N1, N5 and N9 while in courses C10, C13 and C16, they are positioned at cylinder wales N3, N7 and N11. All dial stitches are welt stitches except for courses C1, C4, C7, C10, C13, C16 and C18 where they are knit stitches.

In this fashion, for this particular embodiment, the repeat pattern for the holes is of two consecutive groups of nine courses each in the vertical axis, while on the horizontal axis, it is of four cylinder wales each. It may be appreciated that these holes may be relocated in the fabric to give a straight linear vertical and horizontal arrangement, a diagonal effect or other geometrical arrangement.

The laminated effect of the fabric may be achieved by setting the front color yarns on the feeds of courses C1, C4, C7, C10, C13 and C16, and setting the back color yarns on the feeds of courses C2, C3, C5, C8, C9, C11, C12, C14, C15, C17 and C18. The front color effect may be achieved by the knit stitches on the dial and the tuck stitches on the cylinder of the courses where the feed is set with the front color yarn while the back color effect may be achieved by the knit stitches on the cylinder of the courses where the feed may be set with the back color yarn. This way, the back color only shows up on the front of the fabric where the holes are located. Furthermore, on courses C2, C5, C8, C11, C14 and C17, the back color yarn may be full knitted on cylinder needles N1, N2 and N4 to make a balanced back tension on each side of the hole. Also, on courses C3, C6, C9, C12, C15 and C18, the back color yarns may be full knitted on cylinder needle N3 and may be only a welt stitch on the other cylinder needles. This welt effect has the property of improving the hiding of the back color when the front color is making a tuck movement.

Figure 3:
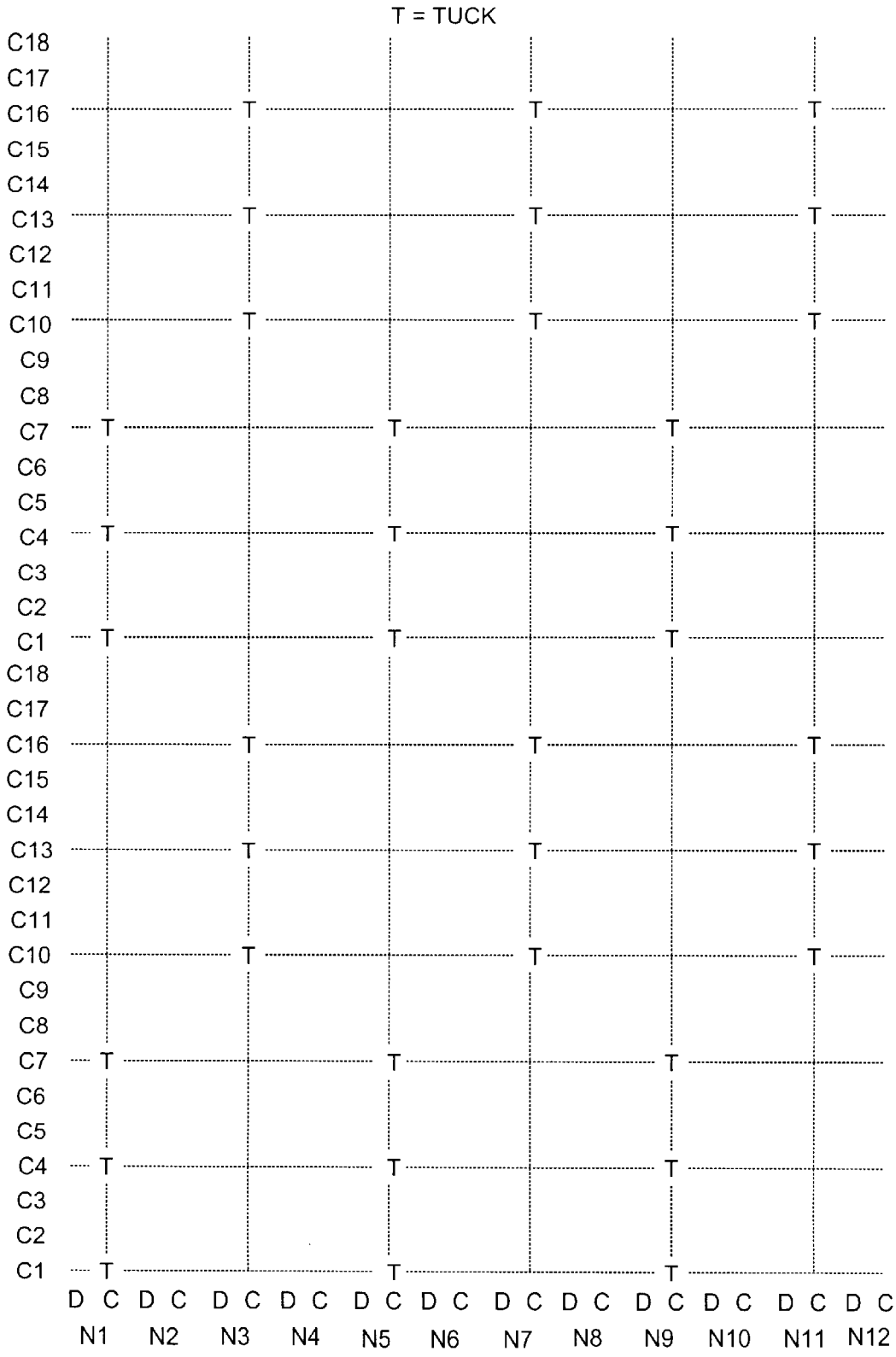
FIG. 3 is a grid schematic representation of the holes assembly in a particular embodiment.

In this particular embodiment, the alignment of the holes may be such as to make diagonal lines with a repeat at every two groups of nine courses and every group of four cylinder wales as illustrated in FIG. 3. In an alternate embodiment, the distance between the holes can be closer or greater than in the particular embodiment. The result may be in having a greater or lesser number of holes and disposition thereof in the fabric. For example, the holes may be knitted closer together, therefore instead of having tuck stitches at cylinder wales N1, N5 and N9 for the first set of courses and at cylinder wales N3, N7 and N11 for the second set of courses, they may be closer such as at cylinder wales N1, N4, N7 and N10 for the first set of courses at cylinder wales and N3, N6, N9 and N12 for the second set of courses. As well, the holes may be knitted farther apart, therefore instead of having tuck stitches at cylinder wales N1, N5 and N9 for the first set of courses and at cylinder wales N3, N7 and N11 for the second set of courses, they may be farther such as at cylinder wales N1, and N7 for the first set of courses and at cylinder wales N3 and N12 for the second set of courses.

It may even be possible to group together three consecutive groups of six courses each, instead of two groups of nine courses each, resulting in a shorter hole. Thus, to preserve the diagonal linear effect or alignment of the holes in the double knit fabric, the hole configurations of the three sets of courses C1 to C6, C7 to C12 and C13 to C18 inclusive are offset to the right one in relation to the lower one, by two cylinder wales. Comparing courses C1 and C4 with courses C7 and C10 wherein the three tuck stitches on the cylinder of courses C1 and C4 are at wales N1, N5 and N9 while in courses C7 and C10, they are at wales N3, N7 and N11. Similarly, comparing courses C7 and C10 with courses C13 and C18 wherein the three tuck stitches on the cylinder of courses C7 and C10 are at wales N3, N7 and N11 while in courses C13 and C18, they are at wales N1, N5 and N9. All dial stitches are welts except for courses C1, C4, C7, C10, C13, C16 and C18 where they are knit stitches.

It can be appreciated though, that many modifications to the hole knitted construction may be made without departing from the invention.

It can also be appreciated that, in order to maintain the laminated effect in an alternate embodiment, the feeds corresponding to the courses containing tuck stitches are set with the front color yarns and the yarn is full knitted on the dial and tucked on the cylinder, while the other feeds are set with the back color yarns and the yarn is full knitted on the cylinder only.

Those skilled in the art will appreciate that in using the invention for making a double-knit fabric with a two color laminated effect and carrying the process hereinafter described, one may use different yarns, of different colors, made of synthetic or natural fiber and of different sizes.

Reasonable variations and modifications are possible within the scope of the foregoing disclosure, the drawings and the appended claims to the invention.

What is claimed is:

1. A fabric of double knit construction, said fabric comprising:

a repeating pattern of at least three courses, a first cylinder wale and a second cylinder wale, said first cylinder wale comprising a tuck stitch in one of said three courses so as to form a hole, a knit stitch in one of the two other remaining courses of said three courses, and a welt stitch in the last remaining course of the said three courses, said pattern being repeated to form the fabric with a plurality of said holes, a minimum spacing between a pair of adjacent said holes formed by the tuck stitch including one cylinder wale in a horizontal direction within the same course as said tuck stitch, two courses in a vertical direction within said first cylinder wale and one cylinder wale and two courses diagonally, and said second cylinder wale comprising two courses with welt stitches and a course with a knit stitch in the same at least three courses as said courses having the tuck stitch.

2. The fabric according to claim 1, wherein in said first cylinder wale, said course with said welt stitch precedes said course with said tuck stitch and said course with said knit stitch follows said course with said tuck stitch.

3. The fabric according to claim 2, wherein in said second cylinder wale, said welt stitches are in the same said courses as said welt and said tuck stitches in said first cylinder, and said knit stitch is in the same said course as said knit stitch in said first cylinder.

4. The fabric according to claim 3, wherein the fabric is knitted with yarns of a first color on said courses comprising at least one said tuck stitch and yarns of a second color for all other said courses so as to provide a two color effect.

5. The fabric according to claim 3, wherein said pattern is repeated three times in a vertical direction and said minimum spacing between adjacent said holes is of three cylinder wales in a horizontal direction and one cylinder wale and eight courses diagonally.

6. The fabric according to claim 5, wherein the fabric is knitted with yarns of a first color on said courses comprising at least one said tuck stitch and yarns of a second color for all other said courses so as to provide a two color effect.

7. The fabric according to claim 1, wherein in said first cylinder wale, said course with said welt stitch follows said course with said knit stitch.

8. The fabric according to claim 7, wherein in said second cylinder wale, said welt stitches are in the same said courses as said welt and said tuck stitches in said first cylinder, and said knit stitch is in the same said course as said knit stitch in said first cylinder.

9. The fabric according to claim 8, wherein the fabric is knitted with yarns of a first color on said courses comprising at least one said tuck stitch and yarns of a second color for all other said courses so as to provide a two color effect.

10. The fabric according to claim 8, wherein said pattern is repeated three times in a vertical direction and said minimum spacing between adjacent said holes is of three cylinder wales in a horizontal direction and one cylinder wale and eight courses diagonally.

11. The fabric according to claim 10, wherein the fabric is knitted with yarns of a first color on said courses comprising at least one said tuck stitch and yarns of a second color for all other said courses so as to provide a two color effect.

12. The fabric according to claim 1, wherein the fabric is knitted with yarns of a first color on said courses comprising at least one said tuck stitch and yarns of a second color for all other said courses so as to provide a two color effect.

13. A fabric of double knit construction comprising:

a repeating pattern of at least three courses, a first cylinder wale and a second cylinder wale, said first cylinder wale comprising a course pattern of a tuck stitch, a knit stitch and a welt stitch, and said second cylinder wale comprising a course pattern of a welt stitch, a knit stitch and a welt stitch.

14. The fabric according to claim 13, wherein said pattern is repeated three times in a vertical direction and wherein there is a minimum spacing between adjacent said holes of three cylinder wales in a horizontal direction and one cylinder wale and eight courses diagonally.

15. The fabric according to claim 14, wherein the fabric is knitted with yarns of a first color on said courses comprising at least one said tuck stitch and yarns of a second color for all other said courses so as to provide a two color effect.

16. The fabric according to claim 13, wherein at least one intermediate cylinder wale is disposed between said first and said second cylinder wales, wherein said at least one intermediate cylinder wale comprises a course pattern of a welt stitch, a knit stitch and a welt stitch.

17. The fabric according to claim 16, wherein the fabric is knitted with yarns of a first color on said courses comprising at least one said tuck stitch and yarns of a second color for all other said courses so as to provide a two color effect.

18. The fabric according to claim 13, wherein the fabric is knitted with yarns of a first color on said courses comprising at least one said tuck stitch and yarns of a second color for all other said courses so as to provide a two color effect.

* * * * *